United States Patent [19]

Held

[11] 4,240,327

[45] Dec. 23, 1980

[54] FLUID OPERATED LINEAR ACTUATOR CONTROL SYSTEM

[75] Inventor: Richard E. Held, Oil Springs, Ky.

[73] Assignee: Harris Corporation, Cleveland, Ohio

[21] Appl. No.: 910,343

[22] Filed: May 30, 1978

[51] Int. Cl.[3] ..... F01B 15/00; F01B 1/00

[52] U.S. Cl. ..... 91/176; 92/66; 91/183; 91/433

[58] Field of Search ..... 91/176, 437, 189 R, 91/433, 183; 92/66

[56] References Cited

U.S. PATENT DOCUMENTS

| | | | |
|---|---|---|---|
| 448,263 | 3/1891 | Rymer | 91/437 |
| 3,090,362 | 5/1962 | Rolls | 91/176 |

FOREIGN PATENT DOCUMENTS

| | | | |
|---|---|---|---|
| 2304801 | 10/1976 | France | 91/176 |
| 1302200 | 1/1973 | United Kingdom | 91/176 |
| 1323065 | 7/1973 | United Kingdom | 92/66 |

*Primary Examiner*—Paul E. Maslousky

*Attorney, Agent, or Firm*—Craig & Antonelli

[57] ABSTRACT

A fluid operated linear actuator control system for drive arrangements of the type wherein two fluid operated linear actuators act upon a shaft at an angle with respect to each other for causing rotation thereof is disclosed. The control system includes a fluid pressure source including a reservoir means, fluid passages connecting the pressure source with each of the fluid operated linear actuators, and control means for communicating the first of the linear actuators with fluid from the pressure source and fluid from the other with the reservoir means to displace the drive arrangement through a first arc sector, and for changing-over the communication to communicate the reservoir with fluid from the one actuator and the other actuator with fluid from the pressure source causing displacement of the drive arrangement through a second arc sector, wherein one of the actuators is in a driving mode while the other actuator is in a floating mode. According to a preferred embodiment, the control enables the drive arrangement to be locked in a fixed position via the use of piloted check valves in the fluid passages and cam switches are utilized to achieve the afore-noted change-over of communication between the actuators and the reservoir and pressure source. The control system is particularly applicable for use with linear actuators for an X-Y axis antenna drive arrangement.

15 Claims, 2 Drawing Figures

X-AXIS
Y-AXIS
PT
EM
50 a.
b.
c.

FLUID OPERATED LINEAR ACTUATOR CONTROL SYSTEM

BACKGROUND AND SUMMARY OF THE INVENTION

The present invention relates to the art of fluid operated linear actuator control systems and in particular such a control system for a drive arrangement of the type wherein two fluid operated linear actuators act upon a shaft at an angle with respect to each other for causing rotation thereof. Such a drive arrangement is disclosed in commonly assigned U.S. patent application Ser. No. 660,114, filed Feb. 23, 1976 by John T. Mazur, and entitled "Rotational Positioning Using Linear Actuators" and the substance of this application is incorporated herein by reference to the extent necessary for a complete understanding of the present invention.

As is pointed out in the afore-noted application, a variety of different arts require the use of a steerable mount to provide rotational positioning of a workpiece, instrument, or other device, such as in radio communications wherein antennas are mounted so as to be steerable through a wide range of arcs. In particular, an advantageous drive arrangement is formed wherein two fluid operated linear actuators act upon a shaft at an angle with respect to each other for causing rotation of the shaft so as to produce the desired rotational positioning as required. Furthermore, the efficiency of operation of such drive arrangements is enhanced when the linear actuators are free to expand or contract without resistance, when deactivated, since any excess resistance to the motion of the inactive actuator will detract from the driving force of the active atuator.

However, in order to produce a drive arrangement which is efficient, reliable, and easy to construct, at a reasonable cost, it is necessary that a fluid control system be developed that is not very complex.

It is therefore an object of the present invention to provide a fluid control system for a drive arrangement of the aforementioned type which is able to power a first linear actuator while rendering inactive a second co-acting linear actuator in a manner that causes the second actuator to offer a minimum of resistance to the force applied by the first actuator.

It is another object of the present invention to provide a control system of reduced complexity and high reliability and efficiency.

These and other objects and advantages of the present invention will become more readily apparent from the following description of a preferred embodiment when viewed in conjunction with the accompanying drawings which are a part hereof.

DETAILED DESCRIPTION OF A PREFERRED EMBODIMENT

Figure 1:
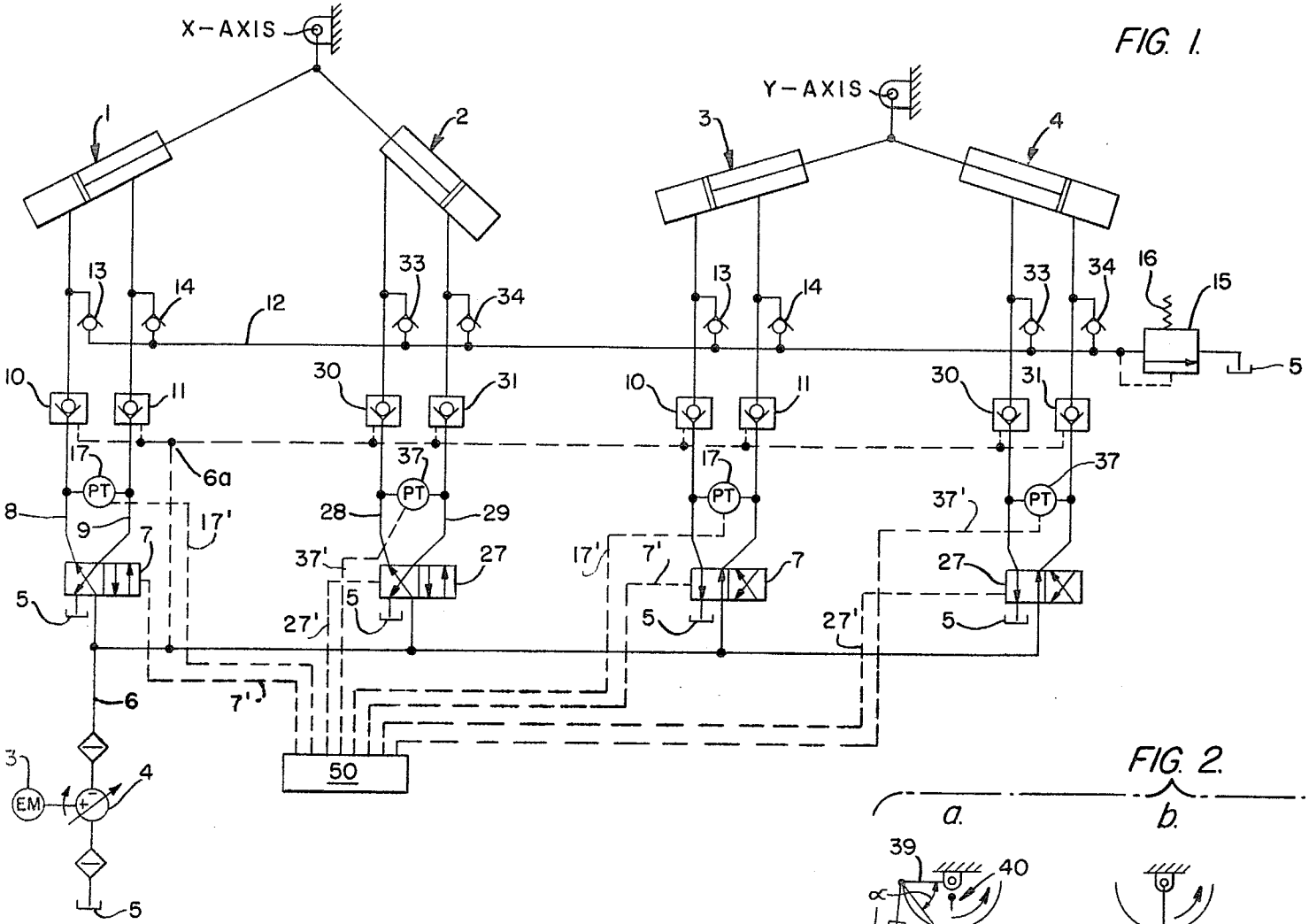
FIG. 1 schematically illustrates a dual axis hydraulic system of the type which would be utilized in conjunction with an X-Y axis antenna.

FIG. 1 of the drawings illustrates a dual axis fluid control system such as would be utilized according to the present invention in conjunction with, for example, an X-Y axis antenna. In this connection, linear actuators 1 and 2, which may be either hydraulic or pneumatic piston-cylinder units, can be utilized to cause displacement about the X-axis, while piston-cylinder linear actuators 3 and 4 cause displacement about the Y-axis.

However, since the operation of the drive arrangement formed by actuators 1 and 2 is the same as that formed by actuators 3 and 4, the control arrangement is likewise the same. Accordingly, for the sake of brevity and to avoid undue repetition, a description of the control system will be had with respect to only that portion relating to the drive arrangement formed by piston-cylinder units 1 and 2, it being understood that statements made with respect to actuator 1 apply as well to actuator 3, and those with respect to actuator 2 apply as well to actuator 4, and the control system components associated with actuators 1 and 3 and 2 and 4, respectively, have been given the same reference numeral identification.

The fluid operated linear actuator control system according to the present invention utilizes a motor 3 to drive a pump 4 for the purpose of supplying power to the system by withdrawing fluid from the reservoir 5 through line 6. The line 6 selectively communicates via a servo control valve 7 with one of a pair of lines 8 and 9, which are connected to the extension and retraction sides of the piston of actuator 1, respectively. The solenoid valve is preferably of the sliding spool type so that the amount of fluid flowing therethrough can be controlled as well as its direction. Various suitable valves are commercially available, one example being the MOOG Series 62 Servovalves produced by MOOG Inc., Controls Division, East Aurora, New York. Under control of a control unit 50, the valve 7 selectively connects pressure line 6 either to line 8 or line 9, the other line thereof being connected to the reservoir 5 at that time, and the actuator 1 is extended and retracted in that way.

Pilot operated check valves 10 and 11 are provided in the lines 8 and 9, respectively, and are responsive to the pressure in line 6 to positively prevent cylinder motion when the pump is turned off, thus preventing any axis motion from occuring at such time. During normal operation, pilot pressure from the pump (supplied by the dash line portion of line 6 which is identified as 6a in FIG. 1) opens these valves and allows flow in either direction therethrough. This operational characteristic is especially advantageous when the control according to the present invention is utilized in conjunction with antenna systems for geo-stationary satellite operations wherein satellite motion is small and only infrequent re-pointing is required. Additionally, these valves provide a positive stow lock feature for surviving forces such as would exist if an antenna experienced 140 m.p.h. winds in a zenith stow position.

Furthermore, a further safety feature is incorporated into the fluid control system according to the present invention by virtue of the overpressure return line 12, which communicates with the fluid actuator 1 via check valves 13 and 14, and is in communication with the reservoir 5 via a pressure regulator valve 15. As is apparent from the schematic illustration, the pressure in line 12 is able to displace the valve 15 against the force of spring 16 such that, by adjusting the valve shifting force to a pressure of 100 p.s.i. above the pump pressure setting, overpressure protection is provided for the hydraulic cylinder of actuator 1 and the pressure lines 8 and 9. Furthermore, this overprotection circuit prevents an overpressure condition from occuring due to thermal expansion of the hydraulic fluid trapped between the pilot operated check valves and the hydraulic cylinder when the power unit is not operating, and the check valves 13 and 14 always insure that fluid flow in circuit line 12 is only in a direction towards the valve.

In order to enable the piston to move with a minimum of force within the cylinder of actuator 1, a differential pressure transducer 17, for example, a transducer of the potentiometer type, is provided between fluid lines 8 and 9. The use of such transducers in conjunction with servo control valves of the above-referenced MOOG 62 series type for flow control purposes is known per se and is described on page 9 of MOOG 62 series catalog No. 622974. The basic features of such servo control valves are also disclosed in MOOG U.S. Pat. Nos. 3,023,782 and 3,228,423, which patents are incorporated by reference to the extent necessary to complete an understanding of the present invention. By having the output of this differential pressure transducer 17 fed back to the servo control valve 7, via the circuit 17', controller 50 and circuit 7' the flow through lines 8 and 9 can be adjusted relative to each other as a function of the pressure differential measured in the lines by the transducer 17 so that the pressure on the ends of the piston of the fluid actuator 1 can be maintained equal, thereby ensuring a minimum of resistance to movement thereof, as is more fully described below.

In a similar manner, power is supplied to the fluid operated linear actuator 2 by the pump 4 from line 6 via servo controlled valve 27, fluid lines 28 and 29, and piloted check valves 30 and 31. Also, the pressure regulator valve 15 provides overpressure protection to the actuator 2 via the check valves 33, 34 and line 12 in the same manner as noted with respect to actuator 1, and the pressure transducer 37 functions in the same manner with respect to servo valve 27, via circuit 37', controller 50 and circuit 27', as the transducer 17 functions with respect to servo valve 7, via circuit 17', controller 50 and circuit 7'.

Having described the construction of the control system according to the present invention, the operation thereof now will be described, again with reference only to the fluid operated piston-cylinder actuator units 1 and 2, it being understood that the units 3 and 4 operate in the same manner under action of the similarly identified components.

Figure 2:
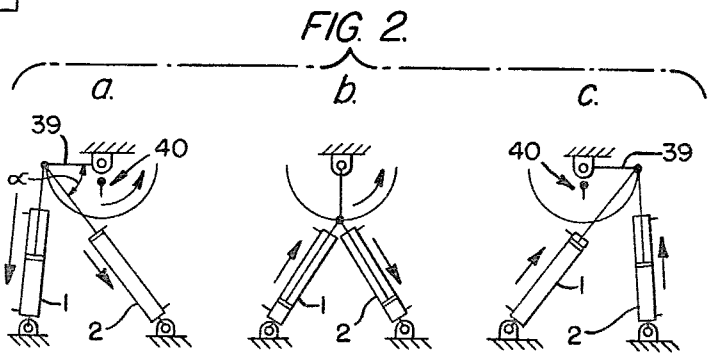
FIG. 2 schematically represents the relative positions of two actuators at a right most arc sector starting point (a), a changeover point (b) and the end point of a second arc sector (c).

Assuming the structure is to be rotated in a counterclockwise direction from the position shown in FIG. 2(*a*) to the position shown in FIG. 2(*c*) under influence of the linear actuator piston-cylinder unit 2, power is applied to motor 3 and the pump 4 delivers hydraulic pressure to the supply line 6. Fluid pressure in the supply line 6a causes the piloted check valves 10, 11, 30, and 31 to open unlocking the lines to the fluid piston-cylinder units.

A signal is sent from the control unit 50 via circuit 27' to servo valve 27 which assumes the position shown in FIG. 1 and with transducer 37 deactivated in response to a signal furnished via circuit 37', fluid flow is supplied to the left-hand chamber formed by the piston within the cylinder of the actuator 2 causing the actuator 2 to be retracted, as seen in FIG. 2(*a*). On the other hand, the pressure transducer 17 detects any pressure differentials existing between lines 8 and 9 and generates a feedback signal which is proportional to the difference in pressure detected. The feedback signal generated is sent via circuit 17' to controller 50 and then on to the servo valve 7 via circuit 7' so as to cause the servo valve 7 to adjust the flow therethrough in a manner reducing the pressure differential, thereby acting to equalize the pressure on the ends of the piston within the cylinder of the actuator 1 so that it can be moved with a minimum of resistance as the actuator 2 causes the structure to be rotated through up to 90° of motion. Thus, with the pressures balanced, there is a very limited restriction of the movement of the actuator 2 due to the undesirable geometry of the actuator 1.

At a point in the path of rotation both cylinders will assume a favorable geometric relationship (which, for the arrangement shown in FIG. 2*b*, occurs at 90°) and beyond that point the cylinder unit 2 will assume an undesirable geometric relationship, while the cylinder unit 1 will assume a favorable geometric relationship. In this regard, it is noted that by favorable geometry it is meant that due to the angle $\alpha$ between the actuators 1, 2 and the shaft rotating lever 39, an effective moment arm is created, while by an unfavorable geometry it is meant that the angle $\alpha$ is such that a moment arm does not exist which is satisfactory for achieving motion in the desired direction. Accordingly, at this point in the path of movement cam switches 40 (schematically represented in the drawings) are arranged so as to be actuated upon by the piston-cylinder unit 2 passing into this area of undesirable geometry. When the cam switches are actuated, a signal is generated and fed to control unit 50 which in turn generates a signal which is fed via circuit 17' to pressure transducer 17 that causes it to be deactivated and a signal which is fed via circuit 37' to pressure transducer 37 which causes it to be activated. Since transducer 17 is deactivated, the servo valve 7 no longer seeks to balance the fluid pressures in lines 8 and 9 (as described above) so that hydraulic fluid will pass therethrough in a normal manner in the direction of the arrows shown on the valve 7 so as to cause positive displacement of the piston within the actuator 1 in response thereto. On the other hand, actuation of pressure transducer 37 causes it to control the flow through servo valve 27 (in the direction of the arrows thereon) via a feedback signal delivered to the servo valve via circuits 37', 27' and controller 50 which is proportional to the pressure differential existing between lines 28, 29. In this manner, servo valve 27 is caused to operate in the same manner noted in the preceding paragraph with respect to actuator 1 so as to balance the pressures on opposite sides of the piston within actuator 2 as it is displaced, thereby limiting the restrictions which would otherwise be imposed on the movement of the actuator due to the now undesirable geometry of actuator 2. In this regard, it is noted that the cam switch signal could be fed directly to the pressure transducers 17 and 37 so as to cause the appropriate activation thereof with the control 50 being responsive to the activation and deactivation of the pressure transducers.

To reverse the direction of rotation, the servo control valve commands from the control unit 50 are reversed and the operation reverses from that described above at any physical position of the structure.

The transition of power to and from actuators 1 and 2 always occurs at the point of equally favorable geometry with the power being switched from the actuator entering an undesirable geometric relationship.

As should be appreciated from the foregoing description of the present invention and the illustration thereof in the drawings, the present invention is of a very simple design that can operate efficiently and effectively.

While I have shown and described one embodiment in accordance with the present invention, it is understood that the same is not limited thereto but is susceptible of numerous changes and modifications as known to those skilled in the art and I therefore do not wish to be limited to the details shown and described herein but indend to cover all such changes and modifications as are encompassed by the scope of the appended claim.

I claim:

1. A fluid operated linear actuator control system for a drive arrangement of the type wherein two fluid operated linear actuators act upon a shaft at an angle with respect to each other for causing rotation thereof, comprising a pair of fluid operated linear actuators, a fluid pressure source including a reservoir, fluid passages connecting the fluid pressure source with each of the fluid operated linear actuators, and control means connected in each of said fluid passages for communicating a first of said actuators with fluid from said pressure source and for deactivating the other of said actuators to displace said drive arrangement under action of only said first actuator through a first arc sector, and for changing-over said communication for deactivating said one actuator and for communicating said other actuator with fluid from said pressure source causing displacement of the drive arrangement through a second arc sector, under action of only said other actuator whereby one of said actuators is in a driving mode while the other actuator is in a floating mode, and means in communication with the pressure of fluid flow into and out of each of said linear actuators and operable, when a linear actuator is in a floating mode, for adjusting fluid flows to and from a deactivated linear actuator in a manner acting to equalize fluid pressures to which opposite sides of the deactivated linear actuator are exposed.

2. A control system according to claim 1, wherein said control means further comprises means for locking said linear actuators to hold said drive arrangement in fixed position.

3. A control system according to claim 2, wherein said means for locking includes piloted check valves in said fluid passages.

4. A control system according to claim 1, wherein a pressure differential transducer is connected between forward and rearward driving passages of the fluid pressure passages communicating with each of said actuators for equalizing the pressures acting therein, thereby permitting the one of the actuators which is in the driving mode to operate with a minimum of resistance from the actuator in said floating mode.

5. A control system according to claim 1, wherein said means for changing-over the communication of said power source with said actuators comprises cam switches responsive to the position of said actuators.

6. A fluid operated linear actuator control system for an X-Y axis antenna drive arrangement of the type wherein a first pair of fluid operated linear actuators act upon an X-axis pivot shaft at an angle with respect to each other for causing rotation thereof, and a second pair of fluid operated linear actuators act upon a Y-axis pivot shaft for causing rotation thereof, comprising a fluid pressure source including a reservoir, and with respect to each of said pairs of actuators: fluid passages connecting the pressure source with each of the fluid operated linear actuators, and control means for communicating a first of said actuators with fluid from said pressure source and for deactivating the other of said actuators to displace said drive arrangement through a first arc sector under action of only said first actuator, and for changing-over said communication for deactivating said one actuator and for communicating said other actuator with fluid from said pressure source causing displacement of the drive arrangement through a second arc sector under action of said other linear actuator, whereby one of said actuators is in a driving mode while the other actuator is in a floating mode.

7. A control system according to claim 6, wherein said control means further comprises means for locking said linear actuators to hold said drive arrangement in fixed position.

8. A control system according to claim 7, wherein said means for locking includes piloted check valves in said fluid passages.

9. A control system according to claim 6, wherein a pressure differential transducer is connected between forward and rearward driving passages of the fluid pressure passages communicating with each of said actuators for equalizing the pressures acting therein, thereby permitting the one of said actuators which is in the driving mode to operate with a minimum of resistance from the actuator in said floating mode.

10. A control system according to claim 6, wherein said means for changing-over the communication of said power source with said actuators comprises cam switches responsive to the position of said actuators.

11. A control system according to claim 4, wherein said means for changing-over the communication of said power source with said actuators comprises cam switches responsive to the position of said actuators.

12. A control system according to claim 11, wherein said control means comprises servo control valves in association with each of said actuators and wherein said means for changing-over causes the pressure differential transducer associated with the actuator that is in the floating mode to be activated for adjusting the servo control valve in association therewith and causes the pressure differential transducer associated with the actuator that is in a driving mode to be deactivated for enabling fluid supply independent of said pressure differential transducer.

13. A control system according to claim 9, wherein said means for changing-over the communication of said power source with said actuators comprises cam switches responsive to the position of said actuators.

14. A control system according to claim 13, wherein said control means comprises servo control valves in association with each of said actuators and wherein said means for changing-over causes the pressure differential transducer associated with the actuator that is in the floating mode to be activated for adjusting the servo control valve in association therewith and causes the pressure differential transducer associated with the actuator that is in a driving mode to be deactivated for enabling fluid supply independent of said pressure differential transducer.

15. A control system according to claim 6, further comprising means in communication with the pressure of fluid flow into and out of each of said linear actuators and operable, when a linear actuator is in a floating mode, for adjusting fluid flows to and from a deactivated linear actuator in a manner acting to equalize fluid pressures to which opposite sides of the deactivated linear actuator are exposed.

* * * * *